US012686989B2

(12) United States Patent
Painchaud

(10) Patent No.: US 12,686,989 B2
(45) Date of Patent: Jul. 21, 2026

(54) EARTH-WORKING BUCKET WITH INTEGRATED ACCESS STRUCTURE ATTACHMENT

(71) Applicant: 9257-5810 QUÉBEC INC., Plessisville (CA)

(72) Inventor: Mathias Painchaud, Victoriaville (CA)

(73) Assignee: 9257-5810 QUÉBEC INC., Plessisville (CA)

( * ) Notice: Subject to any disclaimer, the term of this patent is extended or adjusted under 35 U.S.C. 154(b) by 763 days.

(21) Appl. No.: 18/067,179

(22) Filed: Dec. 16, 2022

(65) Prior Publication Data

US 2023/0193585 A1 Jun. 22, 2023

Related U.S. Application Data

(60) Provisional application No. 63/291,976, filed on Dec. 21, 2021.

(51) Int. Cl.
*E02F 3/40* (2006.01)

(52) U.S. Cl.
CPC ..... *E02F 3/40* (2013.01)

(58) Field of Classification Search
CPC ... E02F 3/40; E02F 3/12; E02F 3/4075; E02F 3/60; E02F 9/0833; B60R 3/02; B66F 11/00; B66F 11/04; B66F 11/044
See application file for complete search history.

(56) References Cited

U.S. PATENT DOCUMENTS

| | | | | |
|---|---|---|---|---|
| 5,042,612 | A * | 8/1991 | Bennett | B65G 69/22 182/1 |
| 5,064,023 | A * | 11/1991 | Loeber | E06C 5/02 182/127 |
| 6,068,277 | A * | 5/2000 | Magnussen | B60R 3/02 182/127 |
| 6,401,861 | B1 * | 6/2002 | Marszalek | E06C 9/08 182/86 |
| 8,651,237 | B2 * | 2/2014 | Pulliam | E02F 3/962 182/141 |
| 9,127,435 | B2 * | 9/2015 | Bienfang | E02F 9/226 |
| 12,202,715 | B2 * | 1/2025 | Masters | B66F 9/07559 |

* cited by examiner

*Primary Examiner* — Joseph M Rocca
*Assistant Examiner* — Robert E Pezzuto
(74) *Attorney, Agent, or Firm* — NORTON ROSE FULBRIGHT CANADA LLP

(57) ABSTRACT

An assembly may have a bucket having a main body defining an inner cavity, at least one connector on an outer surface of the main body of the bucket. A user access structure has a framework releasably mounted to the bucket, and at least one complementary connector for engagement with the at least one connector on the bucket. A method for accessing an upper frame of a bucket is also provided.

19 Claims, 2 Drawing Sheets

EARTH-WORKING BUCKET WITH INTEGRATED ACCESS STRUCTURE ATTACHMENT

CROSS-REFERENCE TO RELATED APPLICATION

The present application claims the priority of U.S. Patent Application Ser. No. 63/291,976, filed on Dec. 21, 2021 and incorporated herein by reference.

TECHNICAL FIELD

The present application relates to excavation equipment such as earth-working buckets, also known as excavation buckets, and dippers.

BACKGROUND OF THE ART

Excavation equipment, and in particular earth working buckets such as cable shovel dippers, are used, amongst other applications, for heavy earthwork applications such as mining and excavation. Buckets are hollow tools defining a bowl to carry earth. The buckets typically have a leading edge for the bowl, also known as the lip, that performs a digging action, so as to fill the cavity of the bucket. A closable door is on the trailing end of the bucket, and may be opened to empty the bucket of its content. Due to the weight of the content in the bucket, and the harsh conditions of operation (e.g., moisture, dirt, abrasiveness), parts of the bucket may become worn and may require replacement. For example, the bucket may need metal works, e.g. cutting, grinding, welding, etc.

In some instances, due to the size of the buckets and their use on elevated equipment, maintenance work to be performed on buckets must be performed at some heights above ground. Accordingly, numerous safety measures and equipment must be used in the process, such as a nacelle, ramps, gates, guard railing, etc. The accessibility and use of such equipment may increase downtime and hinder productivity.

SUMMARY

Therefore, in accordance with an assembly comprising a bucket having a main body defining an inner cavity, at least one connector on an outer surface of the main body of the bucket; and a user access structure having a framework releasably mounted to the bucket, and at least one complementary connector for engagement with the at least one connector on the bucket.

Further in accordance with the aspect, for example, the bucket has at least one back casing on an upper frame thereof.

Still further in accordance with the aspect, for example, the at least one connector is in a inner cavity of the at least one back casing.

Still further in accordance with the aspect, for example, at least one opening is defined in a wall of the back casing to provide access to the framework of the user access structure.

Still further in accordance with the aspect, for example, the at least one connector is connected to structural members extending between wall of the back casing and the main body of the bucket.

Still further in accordance with the aspect, for example, the at least one connector includes a rod.

Still further in accordance with the aspect, for example, the framework of the user access structure includes at least one leg abutting against a beam on the main body of the bucket.

Still further in accordance with the aspect, for example, the at least one leg is connected to a remainder of the framework by a joint.

Still further in accordance with the aspect, for example, the joint is a pivot.

Still further in accordance with the aspect, for example, the complementary connector is a hook.

Still further in accordance with the aspect, for example, the user access structure includes a platform.

Still further in accordance with the aspect, for example, the platform is adjacent to a top surface of the bucket.

Still further in accordance with the aspect, for example, the user access structure includes a displaceable extension on the platform, for the platform, the extension and the top surface of the bucket to define continuous flooring.

Still further in accordance with the aspect, for example, the user access structure includes guard railing around the platform.

Still further in accordance with the aspect, for example, the user access structure includes a ladder.

Still further in accordance with the aspect, for example, the user access structure is releasably connected to an upper frame of the bucket.

Still further in accordance with the aspect, for example, an engagement between the at least one connector and the at least one complementary connector is fastener-less.

In accordance with a second aspect of the present disclosure, there is provided a bucket comprising: a main body defining an inner cavity, at least one back casing mounted onto the main body, and at least one connector within the back casing configured for the releasable connection of a user access structure thereto.

In accordance with a third aspect of the present disclosure, there is provided a method for accessing an upper frame of a bucket, comprising: engaging a complementary connector of a user access structure to at least one connector of a bucket, while the bucket is on an excavation equipment; and securing the user access structure to the bucket; and using the user access structure to access the upper frame while the bucket is on the excavation equipment.

Further in accordance with the third aspect, for example, securing the user access structure includes abutting a framework on the bucket.

DETAILED DESCRIPTION

Figure 1:
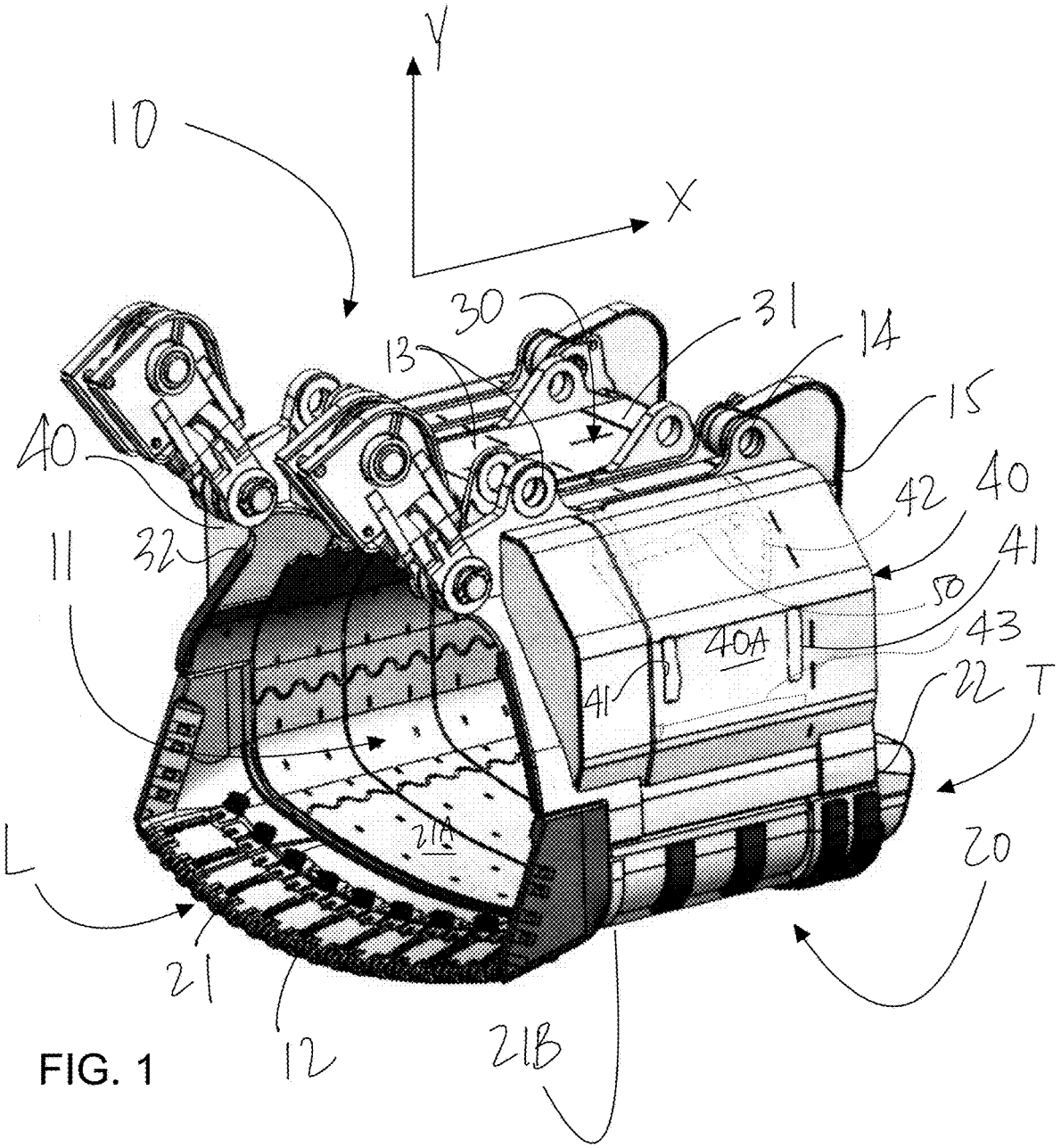
FIG. 1 is a perspective view of an excavation bucket with integrated access structure attachment in accordance with a first variant of the present disclosure.
Figure 2:
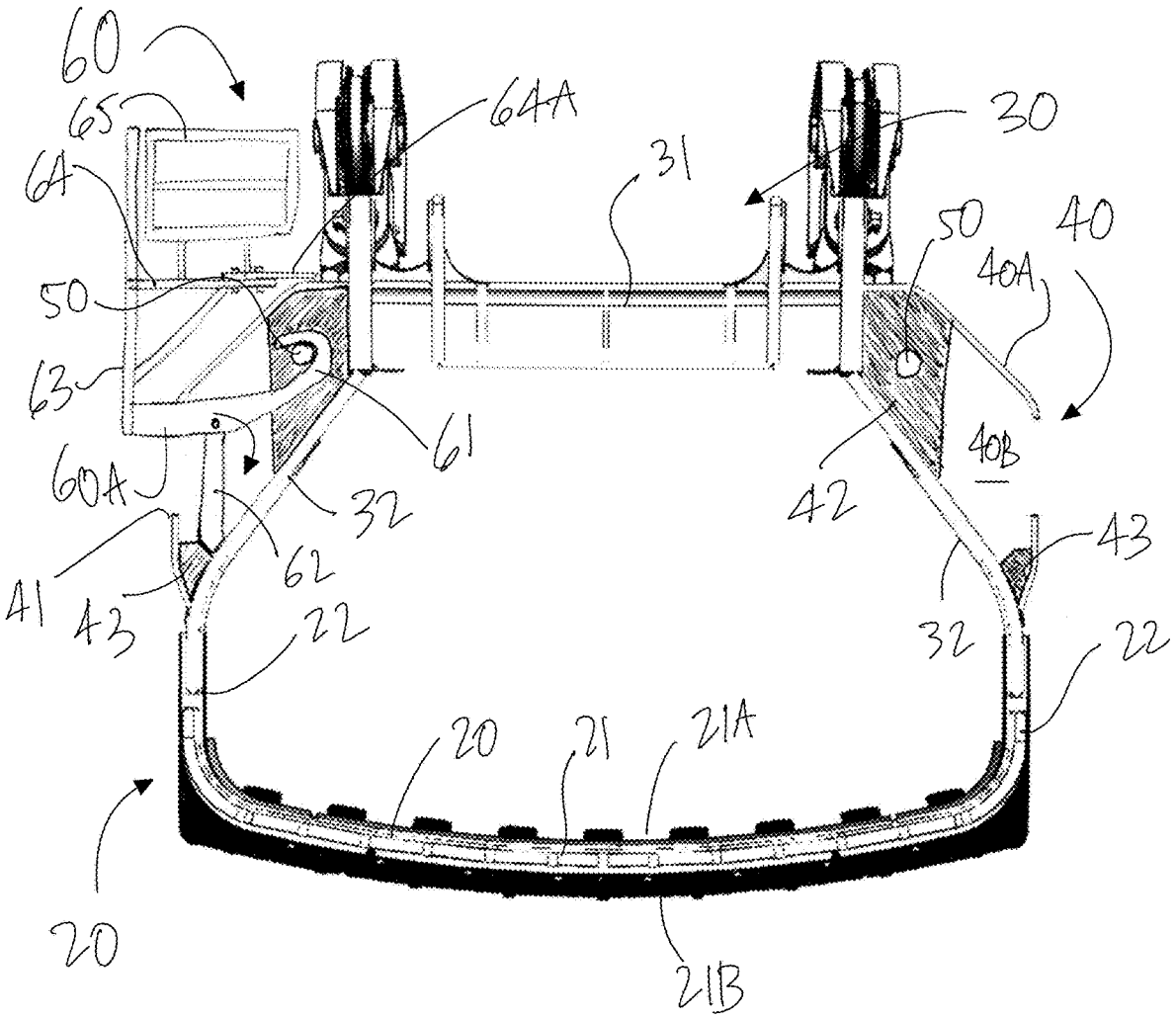
FIG. 2 is a sectional view of the excavation bucket of FIG. 1, showing a user access structure releasably attached to the excavation bucket.

FIGS. 1 and 2 show a bucket such as used for excavation, for example as part of a cable shovel dipper of the type generally used on electric-cable shovels to scoop ore from the ground, and is an example of the numerous types of excavation equipment that may benefit from the configuration described hereinafter for a mechanically attached bowl. Other types of excavation equipment and like earth working buckets include electric rope shovels, hydraulic face shovels, hydraulic backhoe, loader, dragline, bucket-wheel excavator, etc. However, for simplicity, the present disclosure refers to the bucket 10, although it is understood that other excavation equipment may use the configuration described hereinafter.

As a general description, with reference to FIGS. 1 and 2, the bucket 10 has a main body, generally tubular in shape, or hollow as another way to describe the body, having a leading end L for excavation, and a trailing end T opposite the leading end. The tubular body may have an orientation in which the bottom surface of the bucket 10 is generally parallel to the ground, with the open ends of the tubular body being horizontal, and/or with a central axis of the tubular body being horizontal, the central axis being generally parallel to axis X in FIG. 1. The bucket 10 defines an inner cavity 11 for receiving earth or like excavation products, with the lip 12 leading the excavating. The lip 12 is shown generically in FIG. 1, but may have numerous components, such as teeth, shrouds, C-clamps, wear plates, to name a few, and it may differ in shape and configuration to what is shown in FIG. 1. Various connectors 13 are provided on a top surface of the bucket 10, to connect the bucket 10 to a handle, to a stick, to an arm, etc, of a cable shovel dipper, crane or like equipment or vehicle. Any appropriate type of connector may be used.

Pivot supports 14 may be adjacent to a trailing end of the bucket 10. The pivot supports 14 may be provided on both sides of the bucket 10, and are above a trailing opening of the bucket 10, through which the load of earth in the inner cavity 11 of the bucket 10 may be unloaded. The pivot supports 14 are provided to pivotally support a door 15, which door 15 opens the trailing opening and closes the trailing opening. The door 15 is closed during the excavating or digging, while the door 15 is selectively opened to unload the content of the bucket 10.

Still referring to FIGS. 1 and 2, the body of the bucket 10 may be made of two interconnected or integrally formed frame members, namely a bowl 20 and an upper frame 30. The bowl 20 and the upper frame 30 may be interconnected in any appropriate way. The bowl 20 forms the bottom of the bucket 10 and features the lip 12. The upper frame 30 is the upper part of the bucket 10, and features the various connectors 13 and the pivot supports 14, among other features. The upper frame 30 interfaces the bucket 10 to a vehicle or operating equipment, such as to a boom or crane, for example.

The bowl 20 may be defined by a single metallic member, or multiple interconnected members. The bowl 20 has a bottom portion 21 that is generally planar, including the presence of a slight curvature as a possibility. The bottom portion 21 may be referred to as a plate, panel, etc. The bottom portion 21 may have an inner surface 21A, in the inner cavity of the bucket 10, and an outer surface 21B, on an outside of the bucket 10. The inner surface 21A and the outer surface 21B may be generally smooth and continuous. In some variants, surface features may be present.

For reference purposes, a X-Y referential is shown, with the bottom portion 21 being generally parallel to the axis X. Lateral portions 22 project upwardly, i.e., along axis Y, on both sides of the bottom portion 21. In an aspect, the lateral portions 22 are integrally connected to the bottom portion 21, for example as a monoblock construction, or as welded or otherwise secured permanently together. The bowl 20 may define a curved transition from the bottom portion 21 to the lateral portions 22, as shown. However, this is merely an option as the lateral portions 22 may be in a square relation with the bottom portion 21.

Still referring to FIGS. 1 and 2, the upper frame 30 is described in further detail. While the bowl 20 may have a generally U-shape from a leading point of view at L, the upper frame 30 may be said to have an inverted U-shape. The "inverted" is when the bucket 10 is horizontal as in FIG. 1. However, in use the bucket 10 may have other orientations, whereby "inverted" is used to describe the horizontal orientation of the upper frame 30.

The upper frame 30 has a top portion 31 that may be generally planar, with the connectors 13 and pivot members 14 projecting upwardly from the top portion 31. The top portion 31 may be referred to as a plate, panel, etc. In the X-Y referential, the top portion 31 is generally parallel to the axis X. Lateral portions 32 project downwardly, i.e., along axis Y, on both sides of the top portion 31. In an embodiment, the lateral portions 32 are integrally connected to the top portion 31, for example as a monoblock construction, or as welded or otherwise secured permanently together. The upper frame 30 may define a curved transition from the top portion 31 to the lateral portions 32, as shown, and contributing to the inverted U-shape. However, this is merely an option as the lateral portions 32 may be in a square relation with the top portion 31. The lateral portions 32 of the upper frame 30 merge with the lateral portions 22 of the bowl 20 to form the lateral walls of the bucket 10. The lateral portions 22 and 32 may be one and the same, or may be interconnected by various components. For example, the bowl 20 and the upper frame 30 may be detachable from one another, such as in U.S. Patent Application No. 63/112,296, incorporated herein by reference.

Still referring concurrently to FIGS. 1 and 2, the bucket 10 is shown having a pair of back casings 40. The back casings 40 may also be referred to as backs, casings, shields, etc. The back casings 40 are reinforcement and/or shielding structures that may optionally be present to strengthen the bucket 10, at the junction between the top portion 31 and the lateral portions 32 of the upper frame 30. The back casings 40 may extend downwardly to the lateral portions 22 (if differing from the lateral portions 32) and may even extend to the bowl 20. In FIGS. 1 and 2, the bucket 10 has two back casings 40, but the bucket 10 may also have a single one of the back casings 40, or no such back casing 40. The back casings 40 may be rigidly attached to the bucket 10 in any appropriate way, for example by fasteners, by welding, by complementary connection features.

The back casings 40 may be made of metal plates (e.g., sheet metal) to define the main surfaces 40A of the back casings 40. The back casings 40 may define an inner volume 40B interiorly of the main surfaces 40A and exteriorly of the surfaces of the top portion 31 and the lateral portions 32 of the upper frame 30. The inner volume 40B serves as a protective buffer, with the back casings 40 forming a shield against the elements to which the bucket 10 may be exposed. The inner volume 40B may be said to be hollow, or to define an inner cavity.

Openings 41, of any appropriate size and shape may be defined in the main surfaces 40A of the back casings 40, to provide an access to the inner volume 40B and to attachment members therein. The openings 41 are shown as being a pair of elongated upstanding slots, but other opening shapes may be utilized. For example, a single opening 41 (such as a larger one) could be used instead of the two shown, depending on the configuration of access structure used with the bucket 10.

As shown in FIGS. 1 and 2, the openings 41 may be aligned with structural members 42 of the back casings 40. The structural members 42 may for example be plate members that are generally transverse to the walls of the main surfaces 40A of the casing, and may be present to strengthen the back casings 40, by extending for example from the main surface 40A to the walls of the upper frame 30, such as those of the lateral portions 32. For example, the structural members 42 are sheet metal members, as one possibility among others (e.g., brackets, tubes, tabs being alternatives). In an embodiment, the structural members 42 are integrally connected to a wall of the main surfaces 40A, for instance by welding. The structural members 42 may simply abut the upper frame 30 or may be secured to it by welding, by fasteners, by mating engagement, etc. The structural members 42 may be struts in a variant.

Beam(s) 43 may also be present and may be aligned with the opening(s) 41. For example, the beams 43 may be at a junction between the main body of the bucket (e.g., at the lateral portions 22 or 32) and the back casings 40. The beams 43 may also contribute to strengthen the back casings 40. For example, the structural members 42 may be integrally connected to a wall of the main surfaces 40A, for instance by welding. The beam(s) 43 may optionally be present, and alternatives to beam(s) may include blocks, abutments, etc. The structural members 42 and/or beam(s) 43 may be integral parts of the back casings 40, i.e., present regardless of the use of the back casings 40 with a user access structure as described herein.

As part of the integrated access structure attachment, the bucket 10 may have a connector(s) 50 extending between the structural members 42. For example, the connector 50 may be a rod, tube or shaft supported by the structural members 42, or may be a U-shaped structure that is connected to the upper frame 30 or other portion of the bucket 10. As an alternative to a single rod, tube or shaft, a pair of shaft portions or the like may extend from the structural members 42. The rod, tube, shaft, shaft portion(s) are examples of connectors 50 that may be used. Other examples of connectors may include connection holes, bores, pins, bolts, hooks, to name but a few. In the illustrated embodiment, the connector 50 in the form of a rod extends from one of the structural members 42 to the other, by a length L, that corresponds to a gap between the structural members 42. In an embodiment, the connector(s) 50 does not having moving parts, i.e., it is not a mechanism, such that it does not need maintenance steps such as lubricating, greasing, etc. In a variant, the connector(s) 50 is(are) permanently fixed to the bucket 10, in that they are an integral part of the bucket 10 and remain thereon during regular bucket use.

Referring to FIG. 2, a user access structure is generally shown as 60. The user access structure 60 is releasably connectable to the bucket 10, and is firmly secured to the bucket 10 so as to be able to steadily support a user(s) mounting the user access structure 60. The user access structure 60 may be removable from the bucket 10, such that a same user access structure 60 may be used with different buckets 10.

The configuration of the user access structure 60 may be dependent on the contemplated use of the user access structure 60 on the bucket 10. For example, the user access structure 60 may be used to climb onto the bucket 10 to access the upper frame 30. As another example, the user access structure 60 may define a platform upon which a user may stand will accessing the upper frame 30, or the interface between the bucket 10 and a crane or boom.

As observed in FIG. 2, the user access structure 60 may have a framework 60A providing the user access structure 60 with its structural integrity. The framework 60A may include a connector(s) 61 for complementary engagement with the connector(s) 50 of the integrated attachment. The connector(s) 61 are shown as being a hook that is sized to hook onto the connector(s) 50, for instance by defining a cavity that has a shape that emulates that of the connector(s) 50, e.g., round. In an embodiment, the complementary engagement is fastener-less, such that the framework 60A may be readily connected to the connector(s) 50.

The framework 60A may further include legs 62. The legs 62 may project in a downward direction. A location of the legs 62 relative to the connector(s) 61 may be such as to have the legs 62 come into abutment with a structural feature of the bucket 10, such as a beam(s) 43 or other abutment(s). Accordingly, the framework 60A may be connected to the bucket 10 via the connector(s) 50 and 61, and by the abutment of the legs 62 on the beam(s) 43.

In an embodiment, the legs 62 are pivotable within the framework 60A. Indeed, for the framework 60A to penetrate via the opening(s) 41, it may be required that the legs 62 be pivoted to extend along the parts of the framework 60A featuring the connector(s) 61. Once the framework 60A is installed in the manner shown in FIG. 2, the pivoting motion of the legs 62 may be blocked, for instance by cams, by fasteners, by wedges, for the framework 60A to maintain its shape and remain connected to the bucket 10. Moreover, if the framework 60A has a pair of the connectors 61, they may be spaced apart by a distance being less than length L, for the structural members 42 to limit and/or block axial movement along the rod connector 50. Other types of joints may be used for the legs 62 to move, such as telescopic joints, for example. The legs 62 may thus be translatable in a variant and fixed in a given position for example, for example by being connected to a remainder of the framework 60A by translational joints.

As part of the access features, the user access structure 60 may have a ladder portion 63 connected or integrating within the framework 60A. The ladder portion 63 may have a greater length than that illustrated in FIG. 2. For example, the ladder portion 63 may extend at least to the bowl 20 (though shown shorter).

A platform 64 may be mounted on a top of the framework 60A. The platform 64 may be used to serve a flooring for a user to stand or sit on the user access structure 60. The platform 64 may be adjacent to a top surface of the upper frame 30 so as to define a continuous floor therewith. For this purpose, in an embodiment, the platform 64 may optionally include a platform extension 64A. The platform extension 64A may be releasably secured to a remainder of the platform 64, for example by bolts and screws or like fasteners, by sliding joints, by a hinge. For example, different platform extensions 64A may be made available for a user to adapt the user access structure 60 to a given type of bucket 10. The assembly of the platform extension 64A to a remainder of the platform 64 may be done away from the bucket 10, or may be done when the framework 60A is secured to the bucket 10.

Guard railing 65, that may or may not be part of the framework 60A, may also be present. The guard railing 65 may project upwardly from a plane of the platform 64, and may form a cage or an enclosure around the platform 64, to protect a user(s) from an inadvertent fall, for example. The guard railing 65 may be integrally connected to the platform 64, or may be removably installed to it.

In an embodiment, the positioning of the connection features, such as the connector(s) 50, within the inner volume 40B shields same from the materials handled by the bucket 10, and from the elements to which the bucket 10 is exposed due to its outdoor use. It is nonetheless considered to have some of the connection features outside of the back casing 40. Moreover, the back casing 40 may not always be on the bucket 10. The integrated attachment may be present even in the absence of the back casing 40.

In an embodiment, the user access structure 60 abuts against any other parts of the bucket 10, i.e., not necessarily within the inner volume 40B. For example, the framework 60A may have its legs 62 or any other part thereof abut against an outer surface of the back casing 40, or against the lateral portions 22 or 32 or the bowl 20 of the bucket 10. While a dedicated abutment may be present for the legs 62 by way of the beam(s) 43 or like support or abutment, the legs 62 or other part of the user access structure 60 may abut against any suitable surface of the bucket 10, whether in the inner volume 40B or outside thereof.

Therefore, the bucket 10 may be generally described as having a main body defining an inner cavity, a back casing(s) mounted onto the main body and a connector(s) within the back casing configured for the releasable connection of a user access structure thereto.

The bucket 10 and the user access structure 60 may be said to be part of an assembly in which the bucket 10 has a main body defining an inner cavity, at least one connector on an outer surface of the main body of the bucket. The user access structure 60 may be said to have a framework releasably mounted to the bucket, and at least one complementary connector for engagement with the at least one connector on the bucket.

In a variant, a method for accessing an upper frame of a bucket may include steps such as engaging a complementary connector of a user access structure to at least one connector of a bucket, while the bucket is on an excavation equipment; securing the user access structure to the bucket; and using the user access structure to access the upper frame while the bucket is on the excavation equipment. Securing the user access structure includes abutting a framework on the bucket.

The invention claimed is:

1. An assembly comprising:

a bucket for excavation having a main body having a tubular shape defining an inner cavity with at least an open leading end, at least one connector on an outer lateral surface of tubular shape of the main body of the bucket, the at least one connector being tasked for connection of a user access structure; and the user access structure having a framework releasably mounted to the bucket against the outer lateral surface, and at least one complementary connector for engagement with the at least one connector on the bucket.

2. The assembly according to claim 1, wherein the bucket has at least one back casing on an upper frame thereof.

3. The assembly according to claim 2, wherein the at least one connector is in an inner cavity of the at least one back casing.

4. The assembly according to claim 3, wherein at least one opening is defined in a wall of the back casing to provide access to the framework of the user access structure.

5. The assembly according to claim 2, wherein the at least one connector is connected to structural members extending between a wall of the back casing and the main body of the bucket.

6. The assembly according to claim 5, wherein the at least one connector includes a rod.

7. The assembly according to claim 1, wherein the framework of the user access structure includes at least one leg abutting against a beam on the main body of the bucket.

8. The assembly according to claim 7, wherein the at least one leg is connected to a remainder of the framework by a joint.

9. The assembly according to claim 8, wherein the joint is a pivot.

10. The assembly according to claim 1, wherein the complementary connector is a hook.

11. The assembly according to claim 1, wherein the user access structure includes a platform.

12. The assembly according to claim 11, wherein the platform is adjacent to a top surface of the bucket.

13. The assembly according to claim 12, wherein the user access structure includes a displaceable extension on the platform, for the platform, the extension and the top surface of the bucket to define continuous flooring.

14. The assembly according to claim 11, wherein the user access structure includes guard railing around the platform.

15. The assembly according to claim 1, wherein the user access structure includes a ladder.

16. The assembly according to claim 1, wherein the user access structure is releasably connected to an upper frame of the bucket.

17. The assembly according to claim 1, wherein an engagement between the at least one connector and the at least one complementary connector is fastener-less.

18. A method for accessing an upper frame of a bucket for excavation, comprising:

engaging a complementary connector of a user access structure to at least one connector of the bucket, while the bucket is on an excavation equipment, the bucket having a main body having a tubular shape defining an inner cavity with at least an open leading end, the at least one connector being on an outer lateral surface of tubular shape of the main body of the bucket; and securing the user access structure to the bucket against the outer lateral surface; and using the user access structure to access the upper frame while the bucket is on the excavation equipment.

19. The method according to claim 18, wherein securing the user access structure includes abutting a framework against a lateral side of the bucket.

* * * * *